US006385967B1

(12) United States Patent
Chen

(10) Patent No.: US 6,385,967 B1
(45) Date of Patent: May 14, 2002

(54) EXHAUST PIPE FOR MOTOR VEHICLE MUFFLER

(76) Inventor: Shun-Lai Chen, No. 27, Lane 171, Sec. 1, Yuan Dong Rd., Yuanlin Chen, Changhwa Hsien (TW)

( * ) Notice: Subject to any disclaimer, the term of this patent is extended or adjusted under 35 U.S.C. 154(b) by 0 days.

(21) Appl. No.: 09/583,889

(22) Filed: May 31, 2000

(51) Int. Cl.[7] ..... F02B 27/02

(52) U.S. Cl. ..... 60/312; 181/252; 181/279; 181/280

(58) Field of Search ..... 60/312, 313, 314; 181/252, 256, 264, 279, 280

(56) References Cited

U.S. PATENT DOCUMENTS

| | | | | | |
|---|---|---|---|---|---|
| 3,584,701 | A | * | 6/1971 | Freeman | 181/67 |
| 3,786,895 | A | * | 1/1974 | Perrine | 181/49 |
| 3,955,643 | A | * | 5/1976 | Clark | 181/42 |
| 3,957,133 | A | * | 5/1976 | Johnson | 181/60 |
| 3,981,378 | A | * | 9/1976 | Potter | 181/50 |
| 4,899,540 | A | * | 2/1990 | Wagner et al. | 60/303 |
| 4,993,512 | A | * | 2/1991 | Lescher | 181/252 |
| 5,016,438 | A | * | 5/1991 | Harris | 60/299 |
| 5,058,704 | A | * | 10/1991 | Yu | 181/262 |
| 5,101,930 | A | * | 4/1992 | Fargo et al. | 181/252 |
| 5,184,464 | A | * | 2/1993 | Harris | 60/320 |
| 5,198,625 | A | * | 3/1993 | Borla | 181/252 |
| 5,248,859 | A | * | 9/1993 | Borla | 181/238 |
| 5,828,013 | A | * | 10/1998 | Wagner et al. | 60/299 |
| 5,892,186 | A | * | 4/1999 | Flugger | 181/252 |
| 5,902,970 | A | * | 5/1999 | Ferri | 181/252 |
| 6,138,791 | A | * | 10/2000 | Zanzie | 181/252 |
| 6,213,251 | B1 | * | 4/2001 | Kesselring | 181/255 |

FOREIGN PATENT DOCUMENTS

| | | |
|---|---|---|
| JP | 357198310 | * 12/1982 |
| JP | 401036914 | * 2/1989 |

* cited by examiner

*Primary Examiner*—Thomas Denion
*Assistant Examiner*—Diem Tran

(57) ABSTRACT

An exhaust pipe for motor vehicle muffler having a plurality of muffling holes arranged over the periphery, a partially perforated conical tube suspended on the inside and axially extended from the exhaust gas input end thereof for accelerating exhaust gas passing through, and a plurality of spiral portions formed integal with the periphery thereof and spaced around the conical tube for turning exhaust gas escaped from peripheral through holes on the conical tube into a spiral flow.

1 Claim, 5 Drawing Sheets

EXHAUST PIPE FOR MOTOR VEHICLE MUFFLER

BACKGROUND AND SUMMARY OF THE INVENTION

The present invention relates to an exhaust pipe for motor vehicle muffler, and more particularly to such an exhaust pipe, which prevents outside cold air from being sucked into the exhaust pipe to cause a vibration and resonance when the accelerator pedal is released.

Motorcycles and cars are the requisite transportation vehicles to most people for the advantages of high convenience and comfort. A motor vehicle has an exhaust pipe to guide exhaust gas from the engine to the outside air, and a muffler mounted on the exhaust pipe to soften sound. The performance of the exhaust pipe of a motor vehicle greatly affects the performance (horsepower) of the engine. However regular exhaust pipes are still not satisfactory in function. As illustrated in FIG. 5, the exhaust pipe B has a plurality of muffling holes spaced around the periphery within the muffler A. When passing through the exhaust pipe, a part of exhaust gas rushes out of the muffling holes on the exhaust pipe B into the space within the muffler A around the outside wall of the exhaust pipe B to soften sound. This design of exhaust pipe has numerous drawbacks. Because the exhaust pipe is a straight pipe, the major part of exhaust gas directly flows out of the exhaust pipe, and only a small amount of exhaust gas rushing out of the muffling holes. The currents of exhaust gas which rushed out of the muffling holes on the exhaust pipe directly strike the inside wall of the muffler, causing noises. Further, when the driver releases the accelerator pedal, outside cold air will be sucked into the exhaust pipe, causing a resonance and vibration. FIG. 6 shows another structure of exhaust pipe according to the prior art. This structure of exhaust pipe is formed of two spiral pipe portions of different diameters, and has a plurality of muffling holes spaced over the periphery of the spiral pipe portions. The spiral pipe portions simply turn exhaust gas into a spiral flow, however they can not accelerate the velocity of exhaust gas. When exhaust gas rushing out of the muffling holes, it directly strikes the inside wall of the muffler, causing noises.

The present invention has been accomplished to provide an exhaust pipe, which eliminates the aforesaid drawbacks. It is one object of the present invention to provide an exhaust pipe, which accelerates the velocity of exhaust gas which turning exhaust gas into a spiral flow. It is another object of the present invention to provide an exhaust pipe, which prevents outside cold air from being sucked into the exhaust pipe when the accelerator pedal is released. To achieve these and other objects of the present invention, there is provided an exhaust pipe, which comprises a plurality of muffling holes arranged over the periphery, a partially perforated conical tube suspended on the inside an axially extended from the exhaust gas input end thereof for accelerating exhaust gas passing through, and a plurality of spiral portions formed integral with the periphery thereof and spaced around the conical tube for turning exhaust gas escaped from peripheral through holes on the conical tube into a spiral flow and for causing a vacuum to suck escaped exhaust gas from the space within the muffler around the exhaust pipe into the exhaust pipe again.

DETAILED DESCRIPTION OF THE PREFERRED EMBODIMENT

Figure 1:
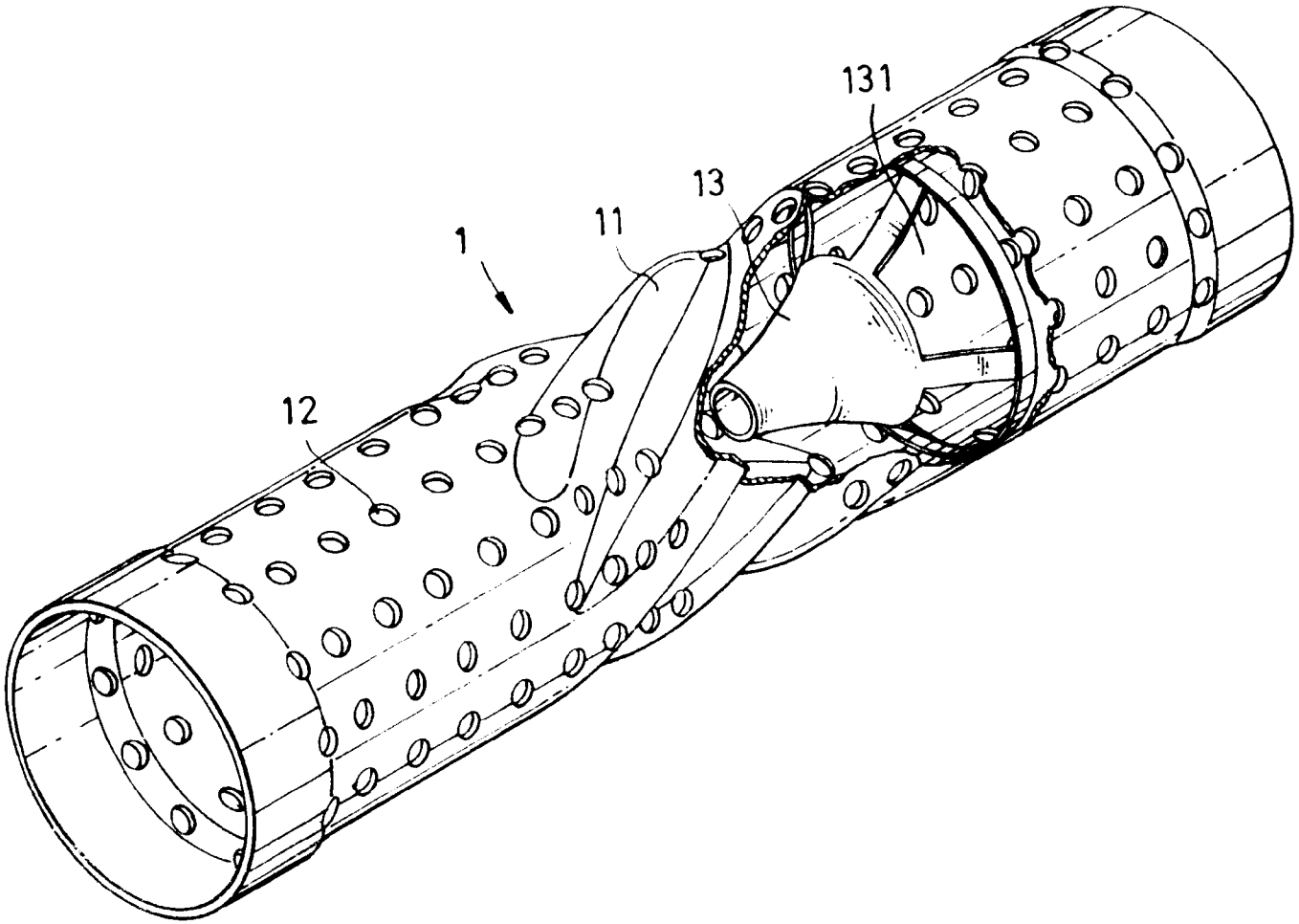
FIG. 1 is a cutaway of an exhaust pipe according to the present invention.
Figure 2:
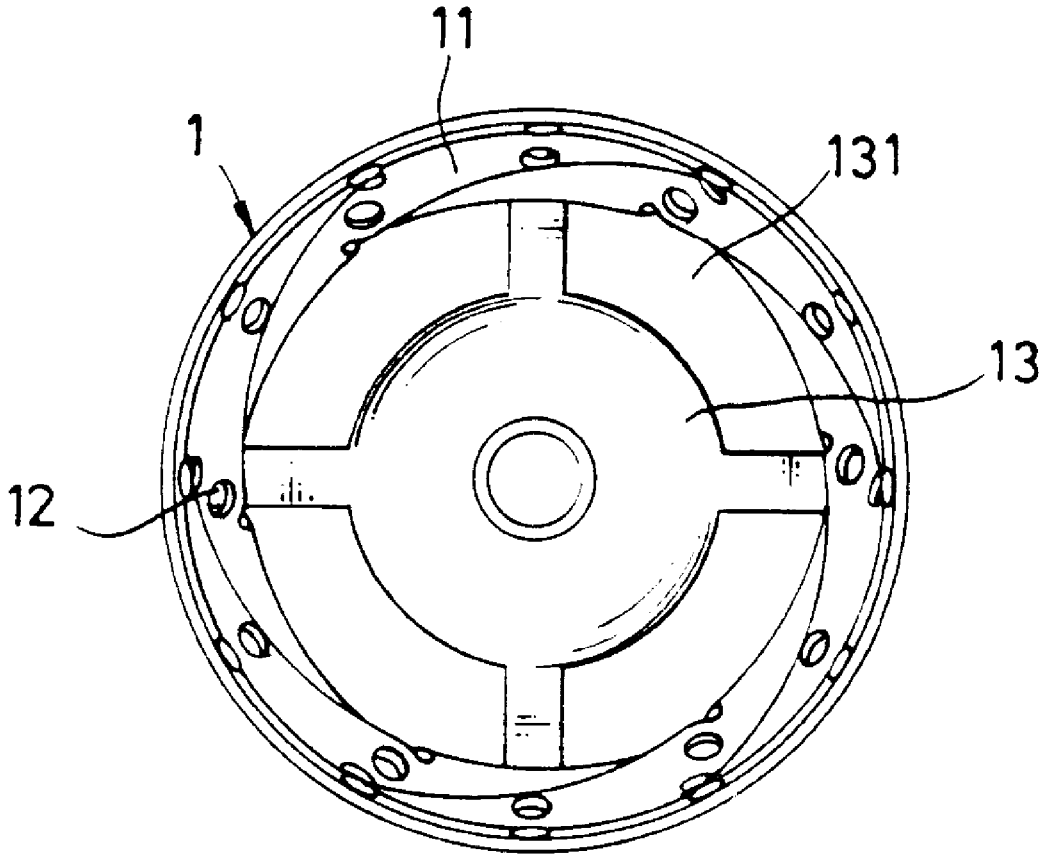
FIG. 2 is a cross-sectional view of the exhaust pipe shown in FIG. 1.
Figure 3:
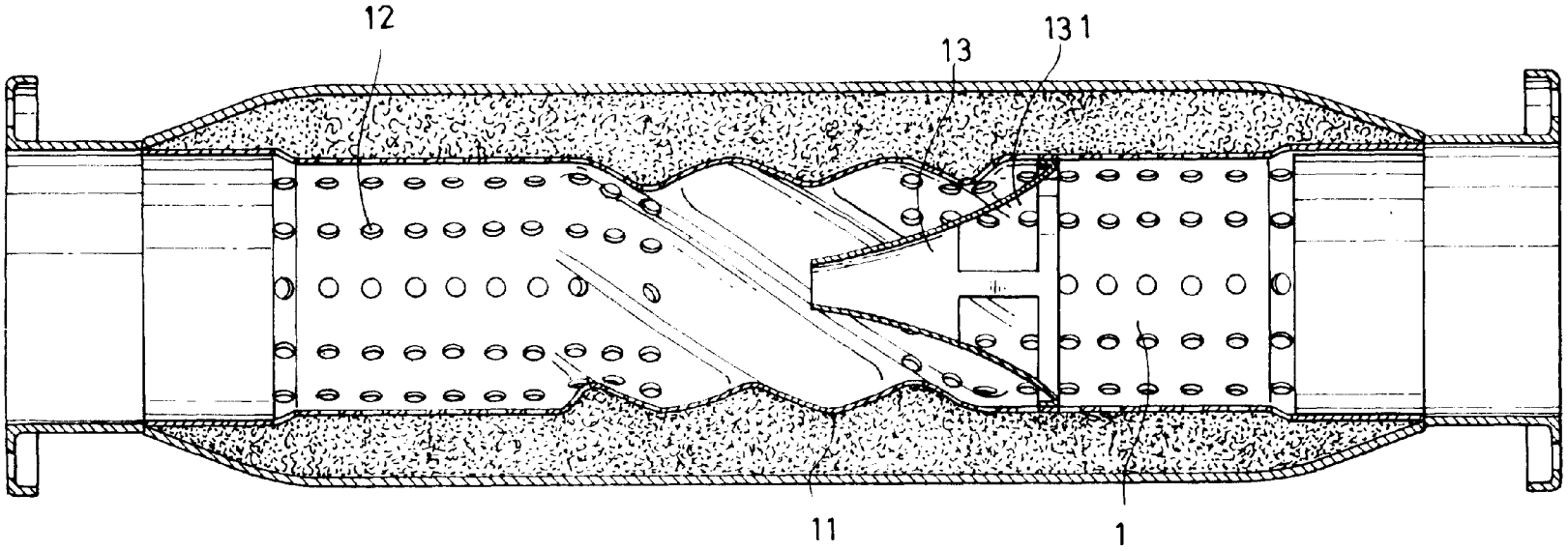
FIG. 3 is a side plain view showing the exhaust pipe installed in a muffler according to the present invention.
Figure 4:
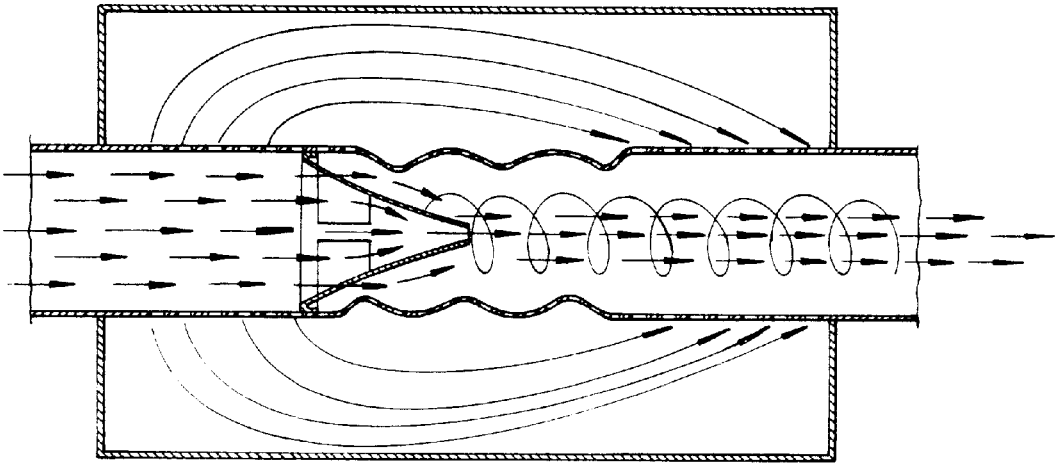
FIG. 4 is a schematic drawing showing the movement of exhaust gas through the exhaust pipe according to the present invention.
Figure 5:
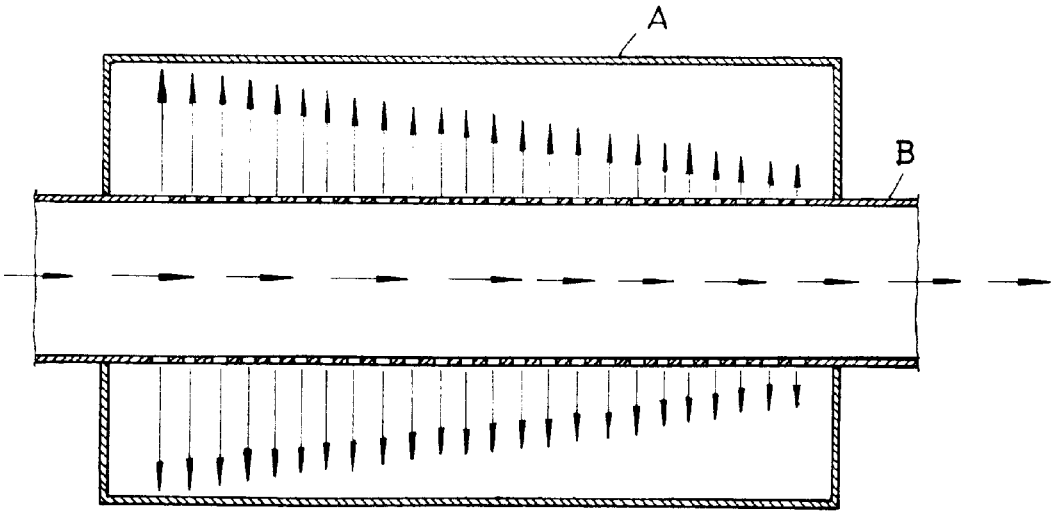
Fig. 5 PRIOR ART
FIG. 5 is a schematic drawing showing the movement of exhaust gas through an exhaust gas in a muffler according to the prior art.
Figure 6:
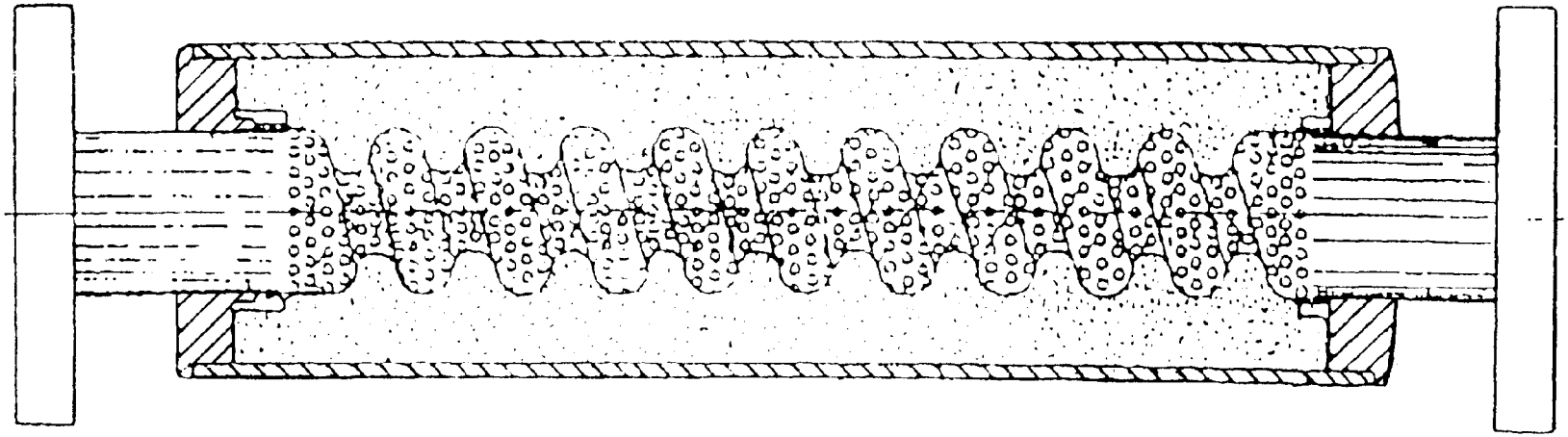
Fig. 6 PRIOR ART
FIG. 6 illustrates another structure of exhaust pipe installed in a muffler according to the prior art.

Referring to Figures from 1 through 4, an exhaust pipe 1 shown comprising a plurality of spiral portions 11 disposed around the periphery of the middle part thereof, a plurality of muffling holes 12 arranged around two distal ends thereof and a part of the spiral portions 11, and a conical inner tube 13 suspended on the inside and axially extended from the exhaust gas input end thereof toward the middle area of the spiral portions 11. The conical inner tube 13 has a diameter made gradually reduced from the exhaust gas input end of the exhaust pipe 1, and a plurality of through holes 131 arranged around the periphery between the exhaust gas input end of the exhaust pipe 1 and the midpoint of the conical inner tube 13. When exhaust gas passes from the engine into the exhaust pipe 1, a major part of exhaust gas passes through the through holes 131 on the conical inner tube 13 toward the spiral portions 11, forming a spiral flow of exhaust gas, and a minor part of exhaust gas directly axially passes through the conical inner tube 13. When axially passing through the conical inner tube 13, the velocity of the axial flow of exhaust gas is accelerated (because the diameter of the conical inner tube 13 is made gradually reduced from the exhaust gas input end). The axial flow of exhaust gas and the spiral flow of exhaust gas are mixed together when passing out of the exhaust pipe 1. When the spiral flow of exhaust gas passing out of the exhaust pipe 1, a vacuum is formed in the peripheral area within the exhaust pipe 1, which induces the currents of exhaust gas that escaped out of the muffling holes 12 around the front end (the exhaust gas input end) of the exhaust pipe 1 into the muffling holes 12 around the rear end (the end opposite to the exhaust gas input end), enabling escaped flows of exhaust gas to be further carried with the spiral flow of exhaust gas and the axial flow of exhaust gas out of the rear end of the exhaust pipe 1 at a high speed. This design greatly reduces impact of exhaust gas against the inside wall of the muffler, and prevents outside cold air from being sucked into the exhaust pipe 1 to cause a vibration and resonance when the accelerator pedal is released, and therefore the noise level is greatly reduced.

It is to be understood that the drawings are designed for purposed of illustration only, and are not intended for use as a definition of the limits and scope of the invention disclosed.

What is claimed is:

1. A motor vehicle muffler comprising an exhaust pipe, said exhaust pipe having cylindrical end parts and a spiraling middle part, a plurality of muffling holes arranged within a periphery of the exhaust pipe in said end parts and said middle part, and said spiraling middle part formed by a plurality of spiral portions formed in the periphery of the exhaust pipe for turning exhaust gas passing through the exhaust pipe into a spiral flow; and a conical inner tube suspended within said exhaust pipe, said conical inner tube extending from an exhaust gas input end of said exhaust pipe into said middle part of said exhaust pipe, said conical inner tube having a diameter gradually reducing from said exhaust gas input of said exhaust pipe to said middle part of said exhaust pipe, said conical inner tube terminating in said middle part of said exhaust pipe, and a plurality of holes disposed around a periphery of said conical inner tube.

* * * * *